US005168585A

United States Patent [19]

Cox

[11] Patent Number: 5,168,585

[45] Date of Patent: Dec. 8, 1992

[54] BATH LIFT

[75] Inventor: Scott Cox, Warwick, Great Britain

[73] Assignee: The Helping Hand Company (Ledbury) Limited, Gloucester, England

[21] Appl. No.: 790,477

[22] Filed: Nov. 12, 1991

[30] Foreign Application Priority Data

Nov. 15, 1990 [GB] United Kingdom ..... 9024881

[51] Int. Cl.[5] ..... A47K 3/12

[52] U.S. Cl. ..... 4/560.1; 4/565.1

[58] Field of Search ..... 4/560.1-566.1

[56] References Cited

U.S. PATENT DOCUMENTS

| | | | |
|---|---|---|---|
| 2,045,110 | 6/1936 | Spiess | 4/562.1 |
| 2,123,398 | 7/1938 | Bowers | 4/562.1 |
| 2,242,939 | 5/1941 | Buckel | 4/565.1 |
| 2,604,638 | 7/1952 | Furry | 4/565.1 |
| 2,624,053 | 1/1953 | Beckwith | 4/565.1 |
| 2,754,523 | 7/1956 | Bruckner et al. | 4/566.1 |
| 3,045,255 | 7/1962 | Pirtle et al. | 4/565.1 |
| 3,317,928 | 5/1967 | Root | 4/561.1 |
| 3,349,411 | 10/1967 | Eaton | 4/564.1 |
| 3,581,316 | 6/1971 | Petersen | 4/566.1 |

*Primary Examiner*—Henry J. Recla
*Assistant Examiner*—Robert M. Fetsuga
*Attorney, Agent, or Firm*—Collard & Roe

[57] ABSTRACT

A bath lift, for raising and lowering an invalid or disabled user out of and into a bath tub, comprises a seat member which is suspended at each side on flexible supporting tapes. The seat member is supported by the tapes through hinged side plates which extend downwardly from the seat member when the latter is in a raised position but which are collapsed below the seat member when the latter is in the fully-lowered position. Thus the seat member when fully lowered is close to the bottom of the bath tub whereas, when fully raised, it is suspended on the tapes above the level of the rim of the bath tub.

8 Claims, 2 Drawing Sheets

BATH LIFT

BACKGROUND OF THE INVENTION

1. Field of the Invention

The invention relates to bath lifts for raising and lowering invalids and disabled users out of an into a bath tub. It is particularly concerned with a bath lift which has a frame which mounts on the rim of a bath tub and a seat supported from the frame, the lift being operative to raise and lower the user in a seated position.

2. Description of the Prior Art

Such a bath lift is known comprising a seat member suspended from the frame on flexible supporting cables. The seat member is raised and lowered by a screw and nut operating mechanism the screw of which extends laterally at the end of the bath for manual operation, the cables being guided over pulleys from the nut of the mechanism. This known lift has a number of significant disadvantages, one of which is that the seat cannot be raised to the top of the bath tub so that it is difficult for a user to get on to, and off, the lift. Another disadvantage is that when raised the seat swings freely which increases the difficulty. A further disadvantage is that the manually-operated mechanism positioned behind the user precludes self-operation of the lift.

SUMMARY OF THE INVENTION

The invention has for its object to provide a more advantageous construction of bath lift.

In a bath lift according to the invention a seat member is suspended on flexible supporting cables or tapes and is supported thereby through collapsible members which extend downwardly from the seat member at least when the latter is in the fully-raised position but which are collapsed below the seat member when the latter is in the fully-lowered position. The words "cables or tapes" as used herein are to be construed broadly as including any elongate flexible members usable to suspend the seat member for the purposes of the invention.

As a result of the invention the seat member can be raised above the rim of the bath tub as the suspension cables or tapes act on the collapsible members at a level below the seat member, whereas due to collapsing of the collapsible members they do not correspondingly limit the effective bathing depth in the tub. A further advantage of the cables or tapes effectively acting at this level is a reduced power requirement, to raise the latter to the top of (and preferably above the rim of) the bath tub, as even in the fully-raised position the cable or tape tension has a considerable vertical component.

Preferably the collapsible members are in the form of hinged or pivotally-mounted struts which fold up below the seat member as the latter reaches the bottom of the bath tub, and automatically extend as the bottom of the tub is cleared during raising movement. They may be provided by hinged side plates respectively mounted along the side edges of the seat member, so as to be collapsed automatically as a result of engagement by the side walls of the bath tub as the full-lowered position is reached. The flexible cables or tapes may be fixed to the side plates and extend below the latter to be anchored underneath the seat member, whereby the length between the fixing and the anchorage limits the erection of the side plates at slightly and inwardly inclined positions relative to the seat member.

Each suspension cable or tape is preferably one of a pair the other of which is connected to the seat member and is slack at all positions other than the fully-raised position. Thus when the lift is fully raised both tapes of each pair are taut, respectively operating at different levels on the associated collapsible member (now erected) and the seat member, so that triangulated tension support of the latter holds it firmly located not only heightwise but also laterally and longitudinally of the bath tub. This, coupled with the fact that the seat member is above the height of the tub makes it easy for the user to slide on to, and off, the seat member. Side flaps may be fixed along the side edges of the seat member so as to drop down at the fully-raised position to extend over the rim of the tub, thus making it even easier for a user to slide on to, and off, the seat member.

Other features of the invention will be apparent from the following description, drawings and claims, the scope of the invention not being limited to the drawings themselves as the drawings are only for the purpose of illustrating a way in which the principles of the invention can be applied. Other embodiments of the invention utilising the same or equivalent principles may be made as desired by those skilled in the art without departing from the present invention and the purview of the appended claims.

BRIEF DESCRIPTION OF THE DRAWINGS

The accompanying diagrammatic drawings illustrate an embodiment of bath lift in accordance with the invention. In the drawings.

DESCRIPTION OF THE PREFERRED EMBODIMENT

Figure 1:
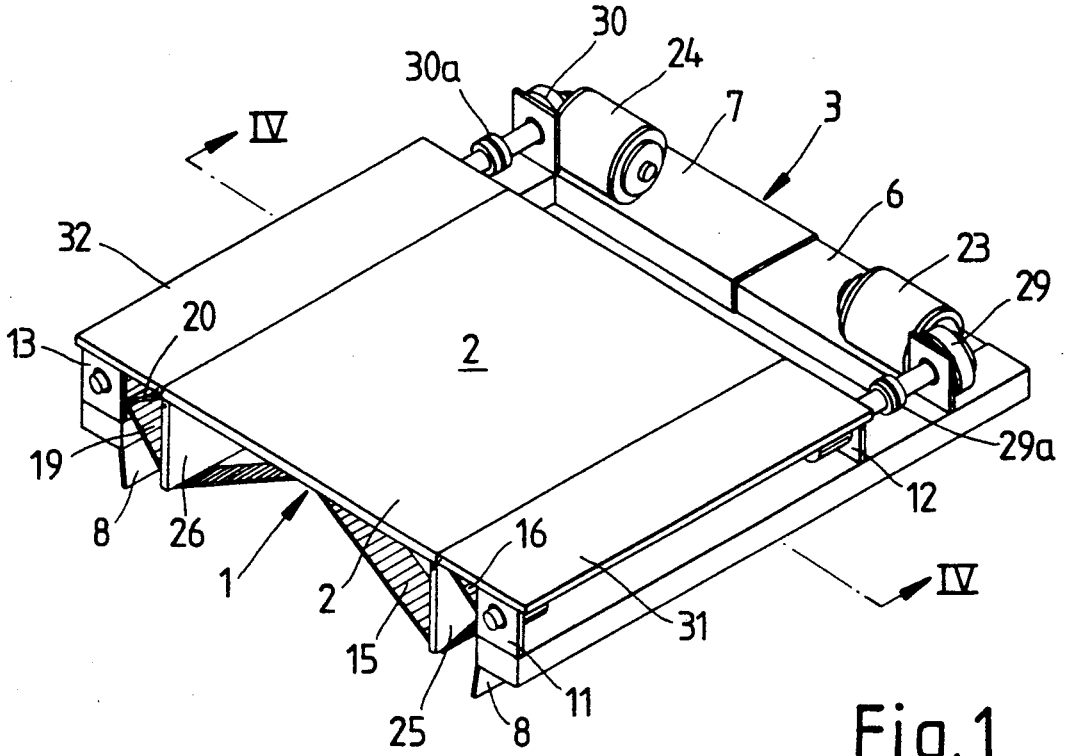
FIGS. 1 to 3 illustrate the bath lift in perspective view, respectively showing a seat member in fully-raised, intermediate and fully-lowered height positions.

The bath lift illustrated has a seat assembly 1 including a seat member 2 of rectangular shape, shown in the drawings by way of example as a flat board whereas in practice it will normally be contoured or otherwise formed to provide more comfortable seating for the user. The seat member 2 is suspended from the side arms of a U-shaped frame 3 which sits on the rim 4 of the bath tub 5 at the head end of the latter. The frame 3 comprises two L-shaped sections 6 and 7 which, at the base of the frame U, fit slidably one within the other for telescopic width adjustment of the frame 3 to suit the bath tub 5 with which the lift is at the time being used. Each frame section 6 or 7 has two spaced locator plates 8 which engage within the bath tub rim 4 for lateral location of the frame 3, as is clearly shown in FIG. 4.

Locking means (not illustrated) are provided to lock the frame members 6,7 together at the adjusted frame width. Parallel winding shafts 9 and 10 are rotatably mounted on the frame members 6 and 7, in bearings in spaced support brackets 11,12 and 13,14 respectively, these shafts running along the side limbs of the frame U. The seat assembly 1 is suspended at the four corners of the seat member 2, from the side shafts 9 and 10, by webbing tapes. These tapes are wound in pairs 15,16 and 17,18 on the shaft 9 and pairs 19,20 and 21,22 on the shaft 10, the shafts respectively being turned by individual reversible electric motors 23 and 24 to raise and lower the seat assembly 1 windlass-fashion. The frame members 6 and 7 include tape guides, respectively 6*a* and 6*b*, with guide slots through which the tapes pass and which thus maintain the overlying paired tape relationships.

The seat assembly includes bottom hinged plates 25 and 26 which are freely hinged along the opposite side edges of the seat member 2. The outer webbing tapes 15 and 17 are secured to the bottom edge of the side plate 25, as by pins such as 27 (FIG. 2), and continue around and below the plate 25 to be secured at the center of the seat member 2 at 28. Similarly, the outer webbing tapes 19 and 21 are secured to the side plate 26 at the bottom edge thereof and to the seat member 2 at the center 28. The result is that in a suspended, i.e. partially-lowered, position of the seat assembly 1 the lower end portions of the tapes 15,17,19,21 are taut to define slightly inwardly inclined positions of the side plates 25 and 26. This condition is illustrated in FIG. 2, the side plates 25 and 26 thus acting as struts through which the seat member 2 is supported during raising and lowering movement by the tapes 15,17,19,21 with the inner tapes 16,18,20,22 at this time slack.

Figure 3:
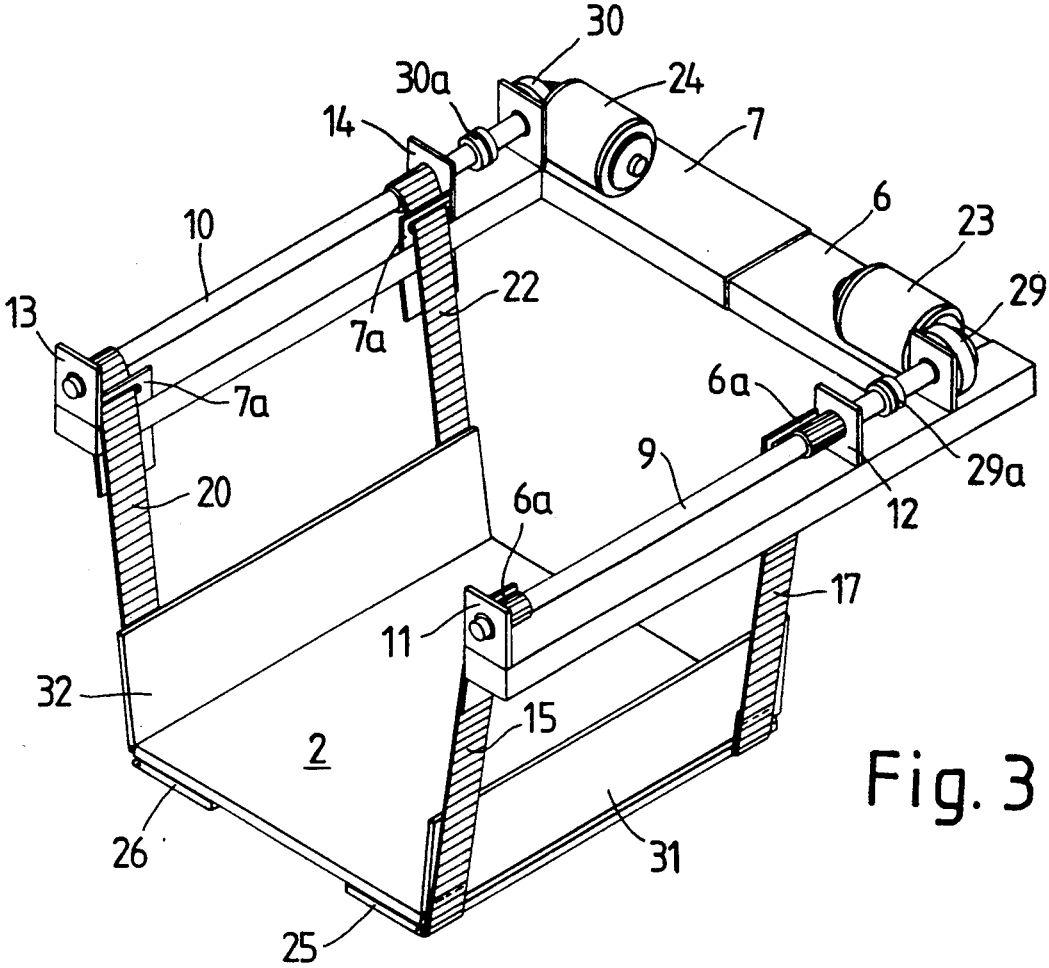

As the seat assembly 1 reaches the bottom of the bath tub the side plates (struts) 25 and 26 are engaged by the side walls 5*a* and 5*b* of the bath tub 5 with a camming action so that they deflect inwardly and fold up beneath the seat member 2. At the fully-lowered position, as illustrated in FIG. 3 and shown in broken lines in FIG. 4, the plates 25 and 26 lie flat against the bottom 5*c* of the tub 5 and the user can bathe, or be bathed, immersed in the bath water.

Figure 2:
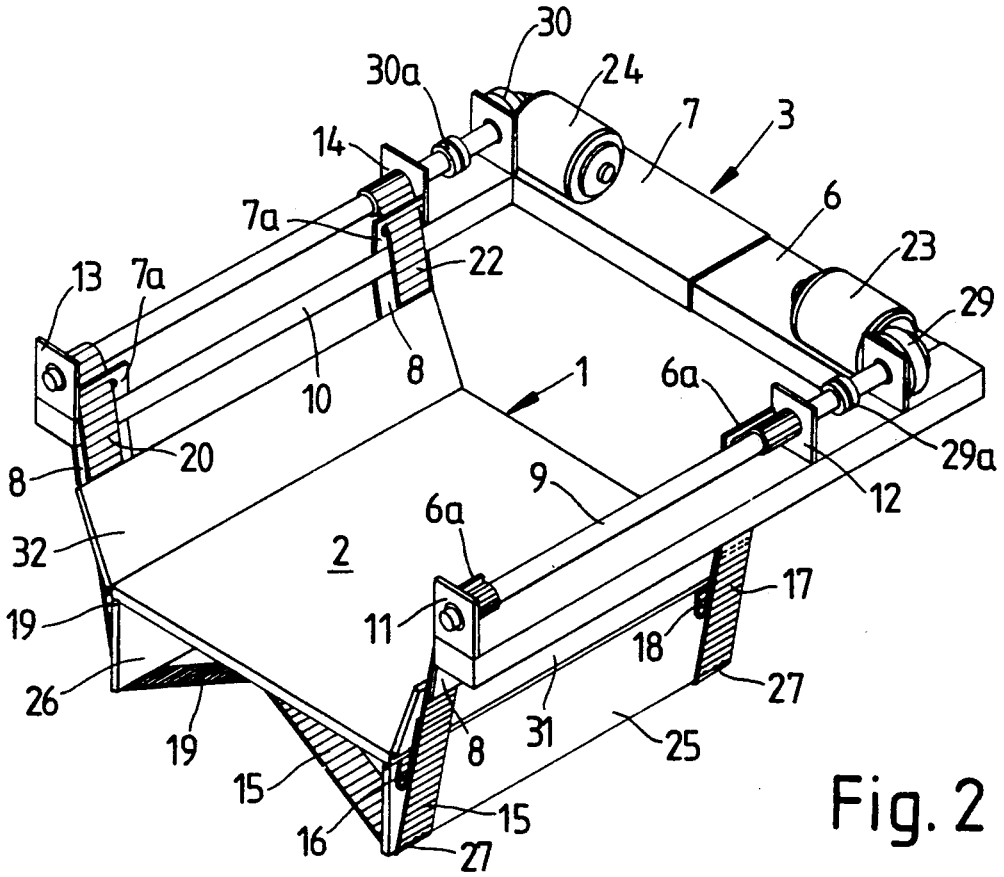

Turning of the shafts 9 and 10 in the appropriate contra-directions by the motors 23 and 24, respectively, raises the seat assembly 1 with the side plates extending back to the FIG. 2 intermediate-height position condition as the assembly 1 clears the tub bottom 5*c*. The motors 23 and 24 are coupled to the shafts 9 and 10 through right-angle reduction gearings 29 and 30 which, being irreversible in the drive sense, effectively lock the shafts 9 and 10 at any height position of the seat assembly 1 and, in particular, produce controlled lowering movement as the suspended weight cannot "run away" with the drive and braking mechanisms are not required. The final drive to the shafts 9 and 10 is through flexible couplings 29*a* and 30*a*, respectively.

Figure 4:
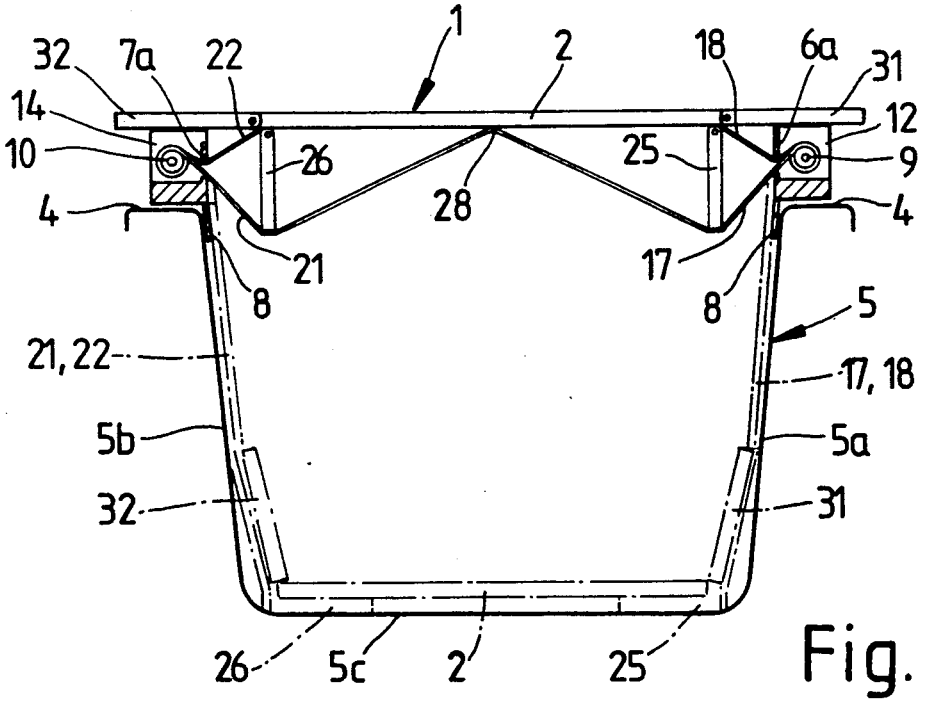
FIG. 4 is a cross-sectional view on the line IV—IV in FIG. 1.

Side flaps 31 and 32 are also freely hinged along the opposite side edges of the seat member 2, so that at intermediate- and fully-lowered height positions these flaps rest against the respective side supporting tapes. However, as the assembly 1 reaches the fully-raised position the seat member 2, due to the provision of the side plates 25 and 26, is lifted above the bath rim 4 by the tapes 15, 17, 19 and 21 and the flaps 31 and 32, as shown in FIGS. 1 and 4, drop down until they lie level with the seat member 2 and rest on the support brackets 11 and 12, or 13 and 14, respectively. Thus a seating surface is provided above the height of the of the bath tub 5, on to and off which the user can slide or be slid. This makes the bath lift especially suitable for access to and from the bath by a wheelchair user. As mentioned this advantage results from the provision of the side plates which enable the seat member 2 to be raised above the height of the tub 5 whilst, being hinged, they fold up beneath the seat member 2 and thus do not substantially restrict the usable depth of the tub 5.

As the fully-raised seat position is approached the inner webbing tapes 16,18,20,22 also go taut and thus, when the seat assembly 1 is fully raised, all the tapes are taut and the seat assembly is firmly suspended between the shafts 9 and 10. As FIG. 4 makes clear a triangulated tension supporting arrangement results, at each side of the seat member 2, from the provision of the webbing pairs and the side plates 25 and 26. Thus the seat assembly is firmly and rigidly held and located centrally of the bath tub 5 whilst the user slides on to and off the seat member 2.

The individual shaft-drive motors 23 and 24 are controlled by a low-voltage control circuit (not illustrated) which has control switches accessible to the user for self operation. This control circuit is servo-controlled, so that the two motors remain in step, and the full-raised position is determined by detecting that the motor speed has decreased to a predetermined minimum as all four webbing tape become taut. The control circuit also incorporates rotation measuring means to compare shaft rotation, the rotation measurement starting during each cycle of operation at the fully-lowered position. Thus at each cycle of operation any necessary corrective action is taken to compensate, for example, for differential stretching of the webbing tapes.

What is claimed is:

1. A bath lift for raising and lowering an invalid or disabled user out of and into a bath tub having sidewalls upstanding from a bottom wall, the left comprising a frame adapted to be positioned on an upper rim of the sidewalls to be supported thereby, a raising/lowering mechanism mounted on the frame, a seat member suspended at opposing sides thereof from the raising/lowering mechanism by flexible supporting cables or tapes, the seat member being connected to the cables or tapes by respective collapsible members which are pivotally connected to respective ones of the opposing sides and which extend downwardly from the seat member at least when the seat member is in a fully-raised position but which are adapted to engage inside surfaces of the sidewalls thereby being cammed into a collapsed position below the seat member when the seat member is in a fully-lowered position adjacent the bath tube bottom wall.

2. A bath lift according to claim 1, wherein the collapsible members are in the form of struts which fold up below the seat member as the latter reaches the bottom of the bath tub, and which automatically extend as the bottom of the tub is cleared during raising movement.

3. A bath lift according to claim 2, wherein the collapsible members are provided by hinged side plates respectively mounted along the side edges of the seat member so as to be collapsed as a result of engagement with the side walls and bottom of the bath tub as the fully-lowered position of the seat member is reached.

4. A bath lift according to claim 3, wherein the flexible cables or tapes are fixed to the respective side plates and extend below the latter and anchored underneath the seat member, whereby the length between the side plate fixings and the underneath anchorages limits erection of the side plates at slightly, and inwardly, inclined positions relative to the seat member.

5. A bath lift according to claim 1, wherein each said suspension cable or tape is one of a pair the other of which is connected to the seat member and is slack at all seat member positions other than the fully-raised position, whereby the seat member is suspended on the tensioned cables or tapes so as to be firmly located not only heightwise but also laterally and lengthwise of the bath tub.

6. A bath lift according to claim 1, wherein the raising/lowering mechanism of the bath lift comprises two rotatable shafts respectively mounted on the frame at the sides of the bath tub, and the seat member is at each side suspended during raising and lowering movement on two of said cables or tapes spaced apart fore and aft of the seat member and wound windlass-fashion on a corresponding one of said two shafts.

7. A bath lift according to claim 1, wherein said suspension cables or tapes are webbing tapes.

8. A bath lift according to claim 1, wherein the bath lift is mountable as a unit on the bath tub when it rests on the rim of the tub and is readily removable therefrom when not required.

* * * * *